US005475993A

United States Patent [19]

Kuo

[11] Patent Number: 5,475,993

[45] Date of Patent: Dec. 19, 1995

[54] LINKAGE LOCK DEVICE

[76] Inventor: Li-Tsao Kuo, No. 47-8, Alley 36, Lane 459, Sec. 1, An-Ho Rd., Tainan, Taiwan

[21] Appl. No.: 261,266

[22] Filed: Jun. 14, 1994

[51] Int. Cl.[6] ..... E05B 67/12

[52] U.S. Cl. ..... 70/18; 70/49; 70/53; 411/504; 411/506

[58] Field of Search ..... 70/18, 30, 49, 70/53, 17; 411/504, 505, 506, 507

[56] References Cited

U.S. PATENT DOCUMENTS

| | | | |
|---|---|---|---|
| 288,559 | 11/1883 | Ekl et al. | 70/18 |
| 565,049 | 8/1896 | Test | 411/506 X |
| 574,961 | 1/1897 | Troast | 70/18 |
| 645,071 | 3/1900 | Conlan | 70/53 |
| 1,460,518 | 7/1923 | Szydlowski | 70/30 |
| 3,747,376 | 7/1973 | White, Jr. | 70/18 |
| 4,292,007 | 9/1981 | Wagner | 411/533 X |
| 4,688,317 | 8/1987 | Matuschek | 411/506 X |
| 4,760,718 | 8/1988 | Muramatsu et al. | 70/18 |
| 5,009,557 | 4/1991 | Dessirier | 411/506 X |

FOREIGN PATENT DOCUMENTS

| | | | |
|---|---|---|---|
| 877220 | 9/1942 | France | 70/53 |
| 335862 | 4/1921 | Germany | 70/18 |
| 1008599 | 5/1957 | Germany | 70/53 |
| 0561110 | 1/1959 | Italy | 411/504 |
| 21797 | 10/1914 | United Kingdom | 70/16 |

*Primary Examiner*—Lloyd A. Gall

*Attorney, Agent, or Firm*—Morton J. Rosenberg; David I. Klein

[57] ABSTRACT

A linkage lock device is provided for fastening objects having either regular or irregular shapes. The lock is composed of a plurality of identical arcuate bars having opposing ends of each bar pivotally connected to an end of another one of the bars to form a chain. One of a pair of free ends is formed to receive a lock mechanism which releasably secures the other free end to form a closed loop to encompass the object being secured against theft. Each pivotal coupling is formed by a pin secured through hardened washers into which the ends of the pin are received.

4 Claims, 22 Drawing Sheets

LINKAGE LOCK DEVICE

BACKGROUND OF THE INVENTION

1. Field of the Invention

This invention relates to a locking device having a plurality of links, and more particularly to a locking device for securing objects of regular or irregular shape.

2. Prior Art

Many types of locks have been invented for various purposes. One such type is a U-shaped lock, as shown in FIG. 15, which includes a shackle having its respective ends insertable into a pair of corresponding apertures in a tubular member and locked by a lock mechanism. This lock has a rigid structure which can only be secured about an object which has an identical shape or which is smaller in size than the opening defined by the shackle. If the object to be secured has a larger size or has an irregular shape, the U-shaped lock is then useless.

A further prior art lock is a Bar Lock Linkage, U.S. Pat. No. 3,747,376, as shown in FIG. 16. Such consists of a bar lock having a plurality of bar links which are pivotally fastened together end to end by rivets. The bar lock has two free ends fastened together by a barrel lock. Each bar link is able to pivot relative to one another at the pivoted connections enabling the bar lock to be folded together into a compact package for storage purposes. But at least one acute angle is formed by a pair of the bar links when locking an object, and the acute angle may incidentally hurt someone.

Another prior art lock is a Bike Security Device, U.S. Pat. No. 3,784,876, as shown in FIG. 17. That device consists of three links, the first link extending a distance which is normally longer than the span between the wheels of a bicycle and having a pair of loops at respective ends adapted for articulated engagement with a second and a third link in a pivotal manner. This device utilizes a padlock to form a securing loop. The padlock is separate from the links and that requires them to be stored separately.

A fourth example of a prior art lock is a Ski Lock, U.S. Pat. No. 585,184, as shown in FIG. 18. The Ski Lock comprises a plurality of plates hinged together to form into a rectangular structure so as to surround a pair of skis disposed in bottom-to-bottom relationship. The end plates are locked together by a padlock with a chain surrounding a permanent fixture so that the skis cannot be stolen. The padlock is also separate from the plates and is required to be stored separately.

A fifth example of a prior art lock is a Wheel Lock, U.S. Pat. No. 4,760,718, as shown in FIG. 19. This type of lock comprises a plurality of rigid members being pivotally coupled to each other and having a lockable connection at the outer ends, so as to form a loop to lock a wheel to an associated fixed element. This device is limited by its space to secure objects. Furthermore, the linkage of such prior art locks is generally composed of a bolt A, as shown in FIG. 20, having a head A1 on top and a shank A2 which includes a larger section A21 and a smaller section A22. A pair of apertures C1, D1 are formed on lock rod C, and D respectively. The inner diameters of the apertures C1, and D1 are slightly larger than the larger section A21 so that the larger section A21 can insert through the apertures C1 and D1. The smaller section A22 will be exposed outward from the end opposite the head A1 and will be hammered flat to hold the bolt A in place, as shown in FIG. 21. Because of the hammering requirement, the bolt A is unable to be processed with heat treatment. This causes the bolt A to be easily broken by shear forces, as shown in FIG. 22.

SUMMARY OF THE INVENTION

It is the primary object of the present invention to provide a linkage lock device having linkages which are processed with heat treatment that will prevent the linkages from being easily broken by severe forces applied thereto.

It is another object of the present invention to provide a linkage lock device which does not form an outwardly directed acute angle.

It is a further object of the present invention to provide a linkage lock device which requires less storage space.

It is still a further object of the present invention to provide a linkage lock device which is easy to operate.

DETAILED DESCRIPTION OF THE PREFERRED EMBODIMENTS

Figure 1:
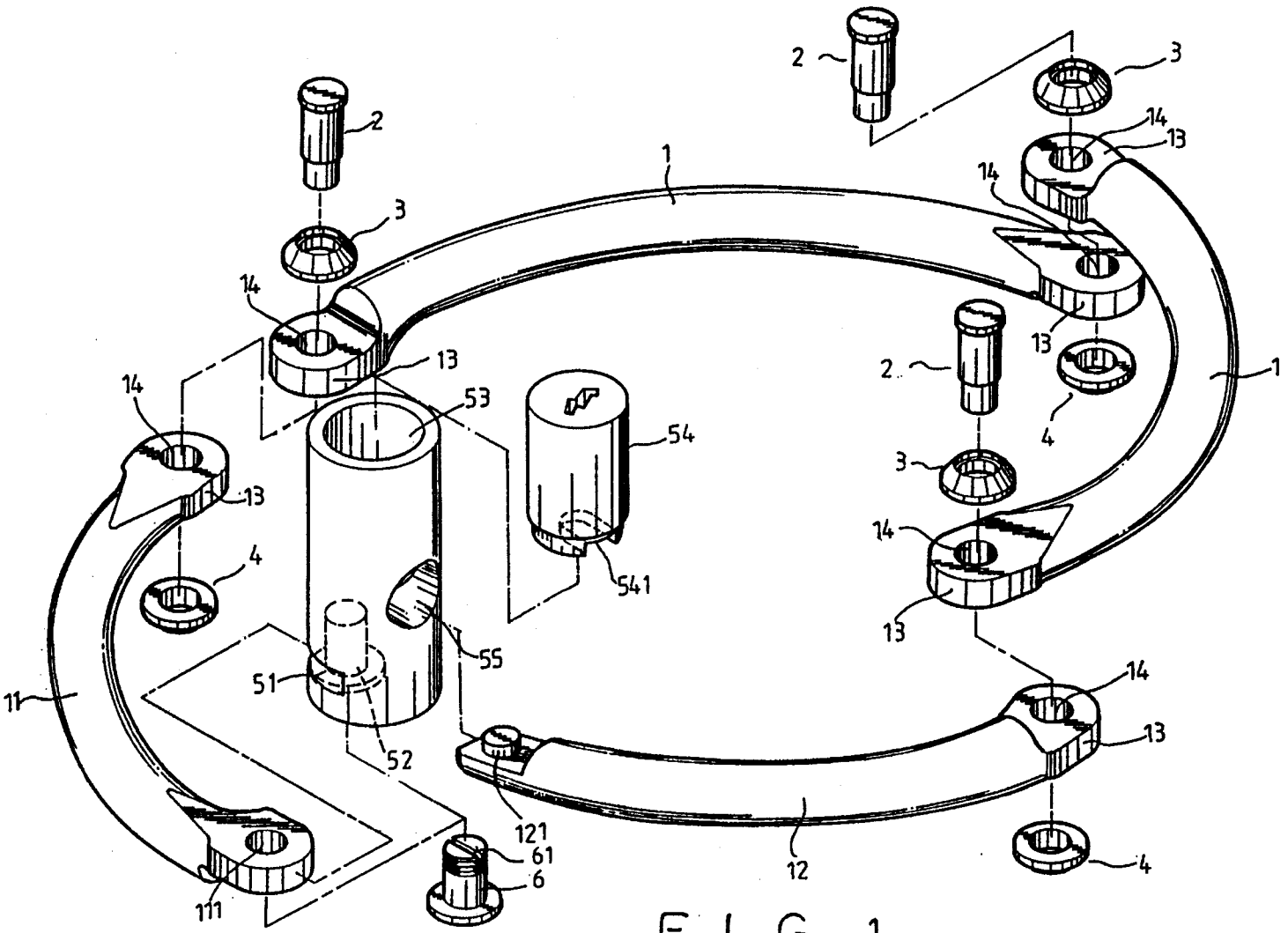
FIG. 1 is an exploded perspective view of the present invention.
Figure 2:
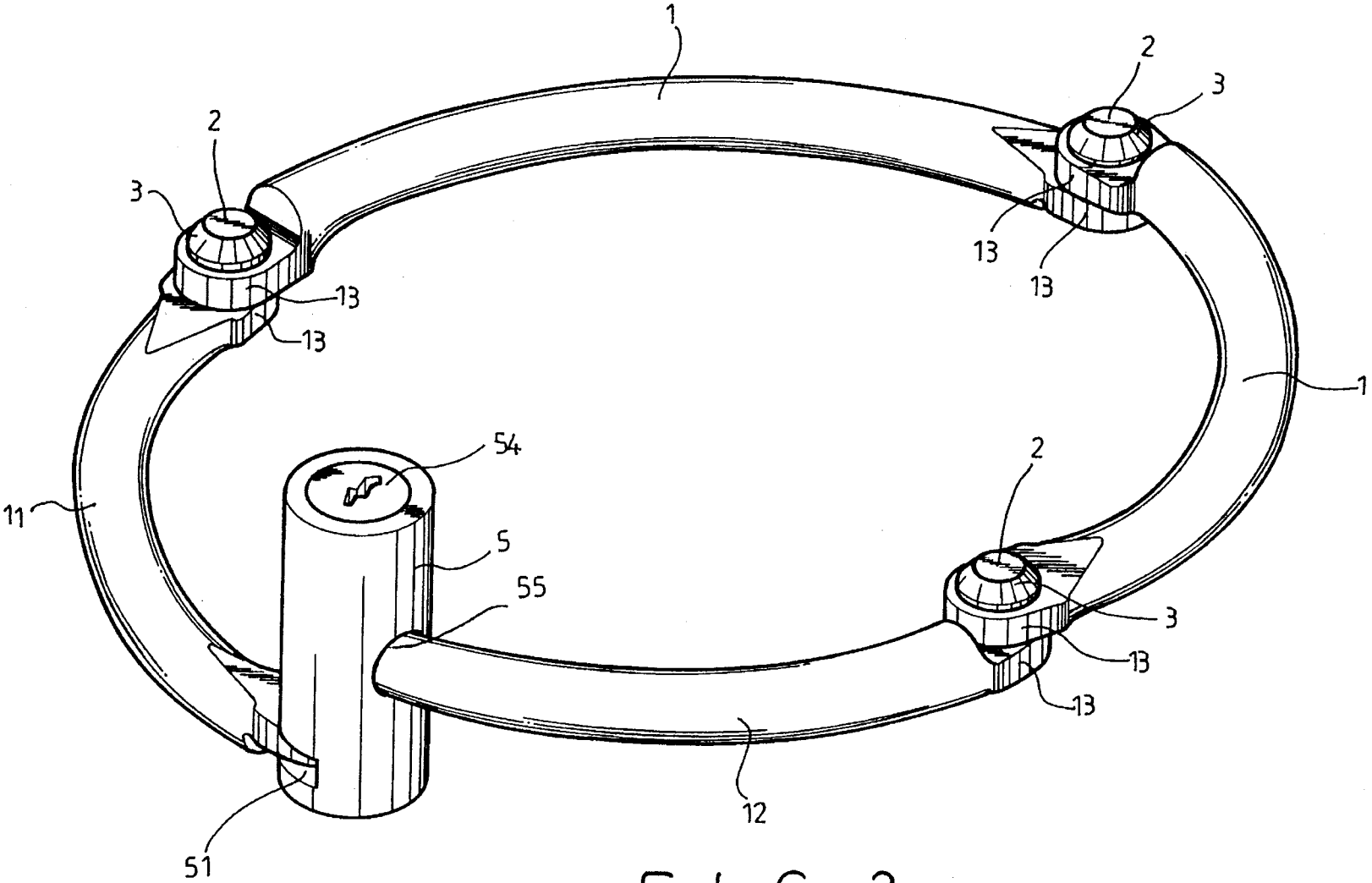
FIG. 2 is a perspective view of the present invention.

Referring now to the drawings wherein such are provided for the purpose of illustrating preferred embodiments only, and not for the purpose of limiting an inventive concept. The linkage lock device, according to the present invention, comprises a plurality of arcuate bars 1 which are hingedly fastened together end to end by pins 2 and a pair of upper and lower washers 3 and 4 to form a chain. The washers 3 and 4 are processed with heat treatment to increase their hardness.

Figure 3A:
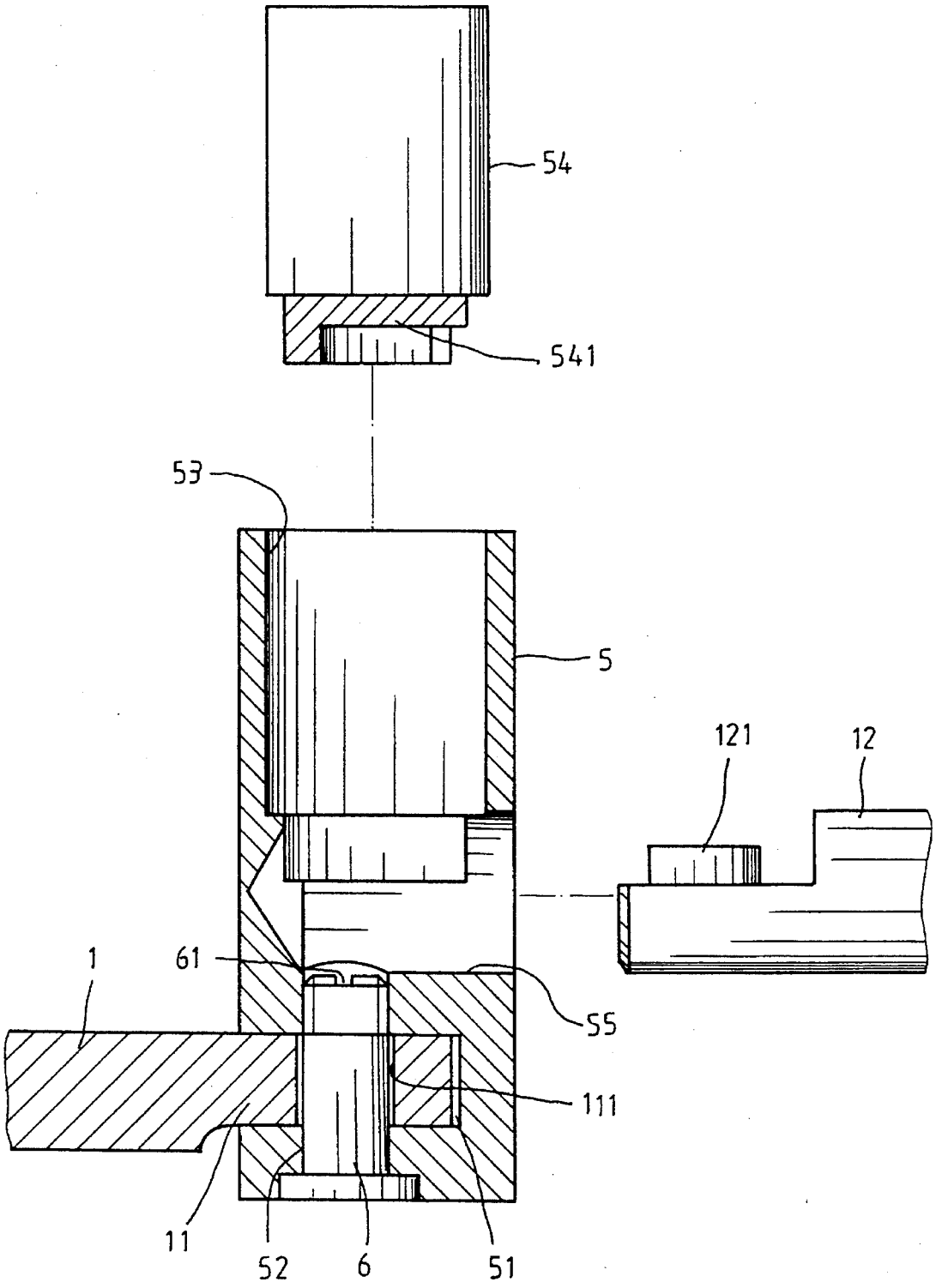
FIG. 3A is an enlarged sectional view showing the latch being disengaged from the lock mechanism of the present invention.
Figure 3C:
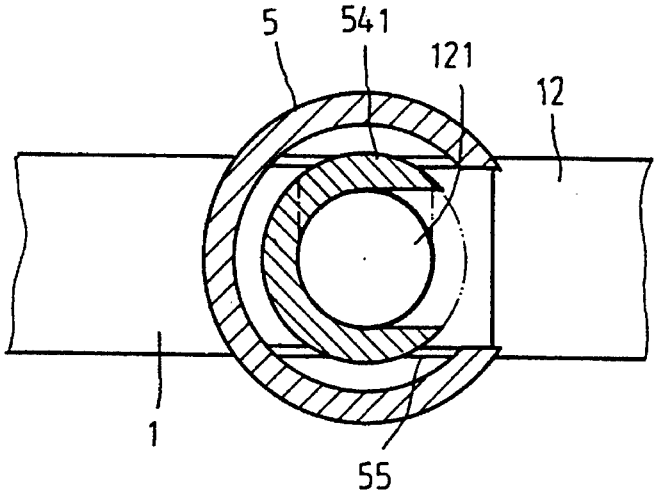
FIG. 3C is a sectional view taken along line 3C—3C of FIG. 3B.
Figure 3B:
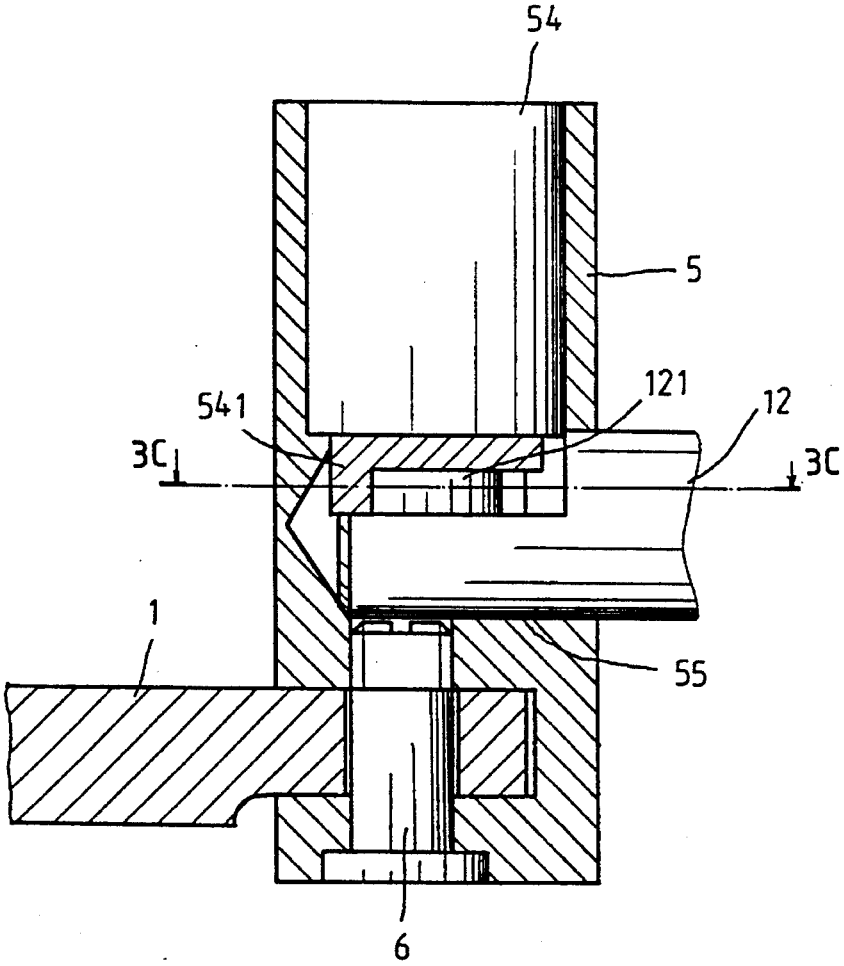
FIG. 3B is an enlarged sectional view showing the latch being engaged with the lock mechanism of the present invention.

The respective ends of each bar 1 are forged to form flat surfaces 13, and have apertures 14 formed at a center portion of the flat surfaces 13. One free end of the chain is inserted into a groove 51 of a lock mechanism 5 and secured by a bolt 6 inserted from a vertical hole 52 formed in the bottom of the lock mechanism 5. The bolt 6 has a slot 61 at a top portion thereof. The vertical hole 52 intersects with the groove 51 and interconnects with a latch hole 55 and a lock core hole 53. Therefore, the bolt 6 is tightened with a standard screw driver from the lock core hole 53, engaging the slot 61 to fasten the bolt 6. The latch hole 55 is adapted to receive the other end, the free end, of the chain. This free end functions like a latch having a recessed portion which has a protuberance 121 extending upwardly, as shown in FIG. 3A, adapted to be inserted into the latch hole 55 and a recessed portion 541 of a lock core 54 for securement thereof, as shown in FIGS. 3B and 3C.

Figure 4A:
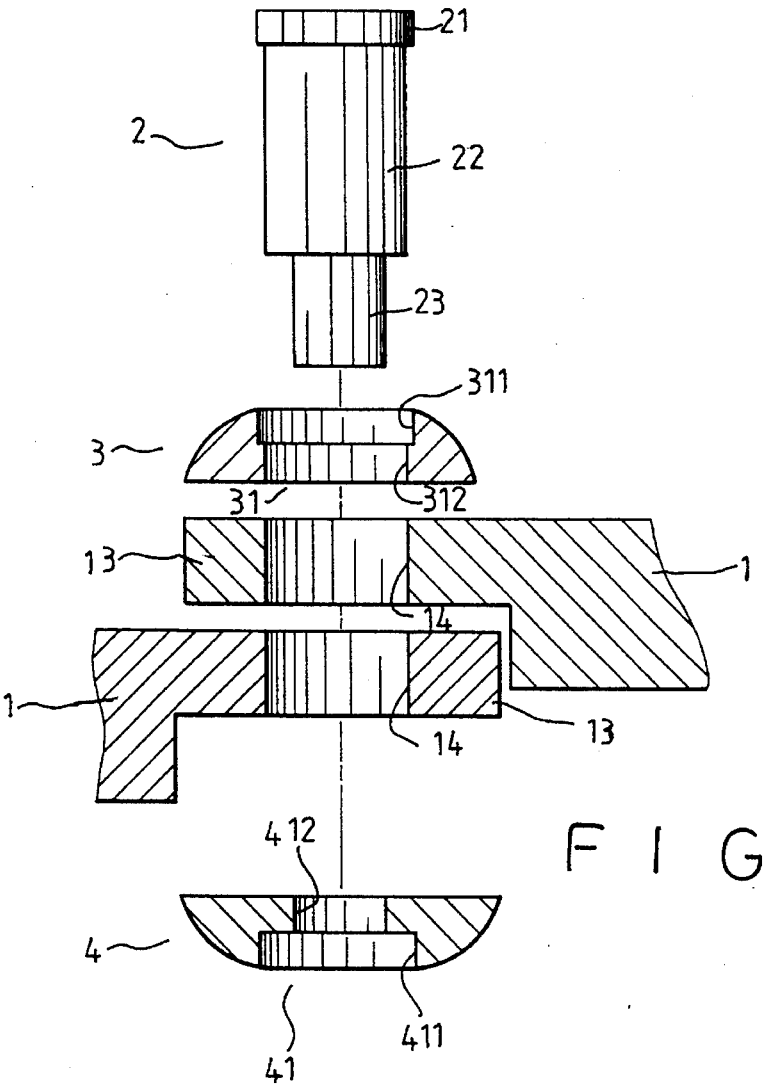
FIG. 4A is an enlarged exploded sectional view of a linkage of the present invention.
Figure 4B:
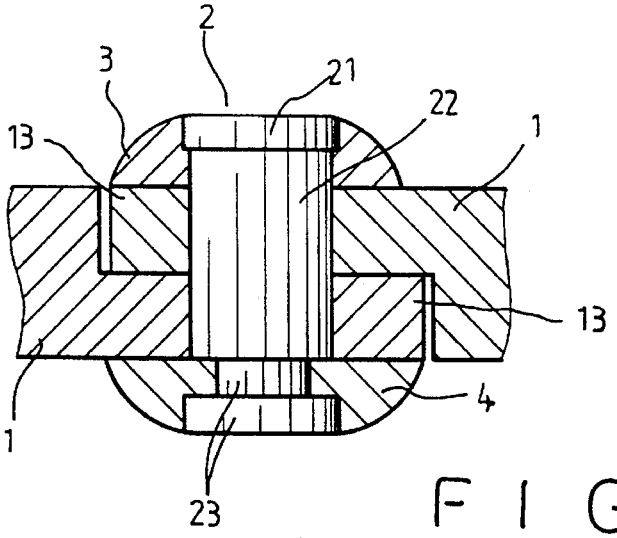
FIG. 4B is an enlarged sectional view of the linkage of the present invention.

Each of the pins 2 includes a head 21 at the top, a first section 22, and a second section 23. Each of the washers 3 and 4 includes a respective through aperture 31, 41 concentrically formed therein. The aperture 31 includes a first section 311 having larger inner diameter adapted to receive the head 21 of the pin 2, and a second section 312 having smaller inner diameter 312 adapted to receive the first section 22 of the pin 2. The aperture 41 includes a first section 411 adapted to receive a flattened portion of the second section 23 of the pin 2, and a second section 412, as shown in FIG. 4A. The pin 2 is inserted into the upper washer 3 and through the apertures 14 and the lower washer 4. The second section 23 of the pin 2 will extend outwardly from the first section 411 of the lower washer 4. The exposed portion of the second section 23 of the pin 2 is then flattened and remains within the first section 411 of the lower washer 4, as shown in FIG. 4B.

Figure 5:
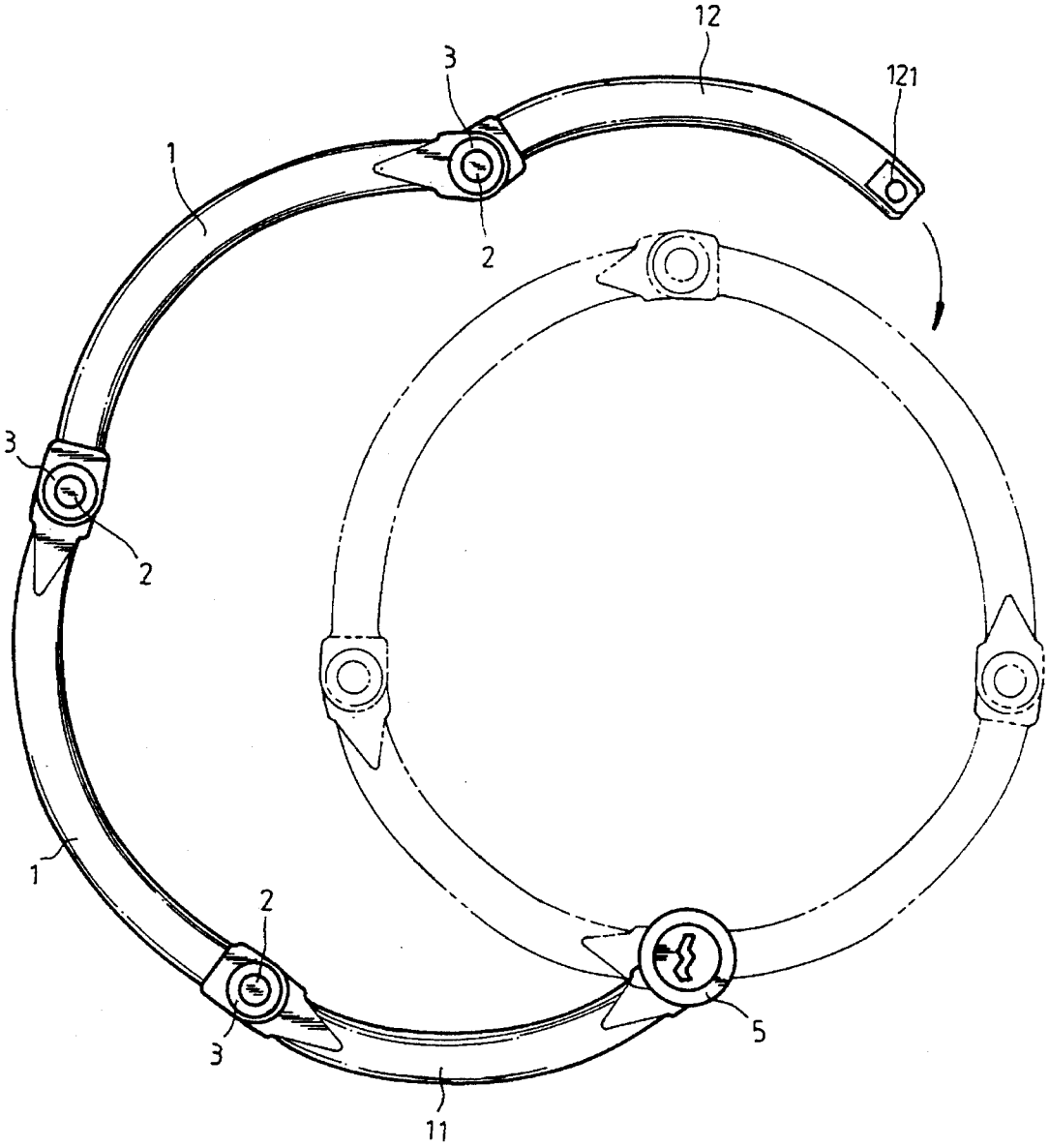
FIG. 5 is a plan view of the present invention, demonstrating the locking method.

To lock the present invention, the rod 12 is pushed toward the bar 11 and the free end is inserted into the aperture 55 of the lock mechanism 5 until the lock core 54 confines the movement of the protuberance 121, as shown in FIG. 5.

Figure 6:
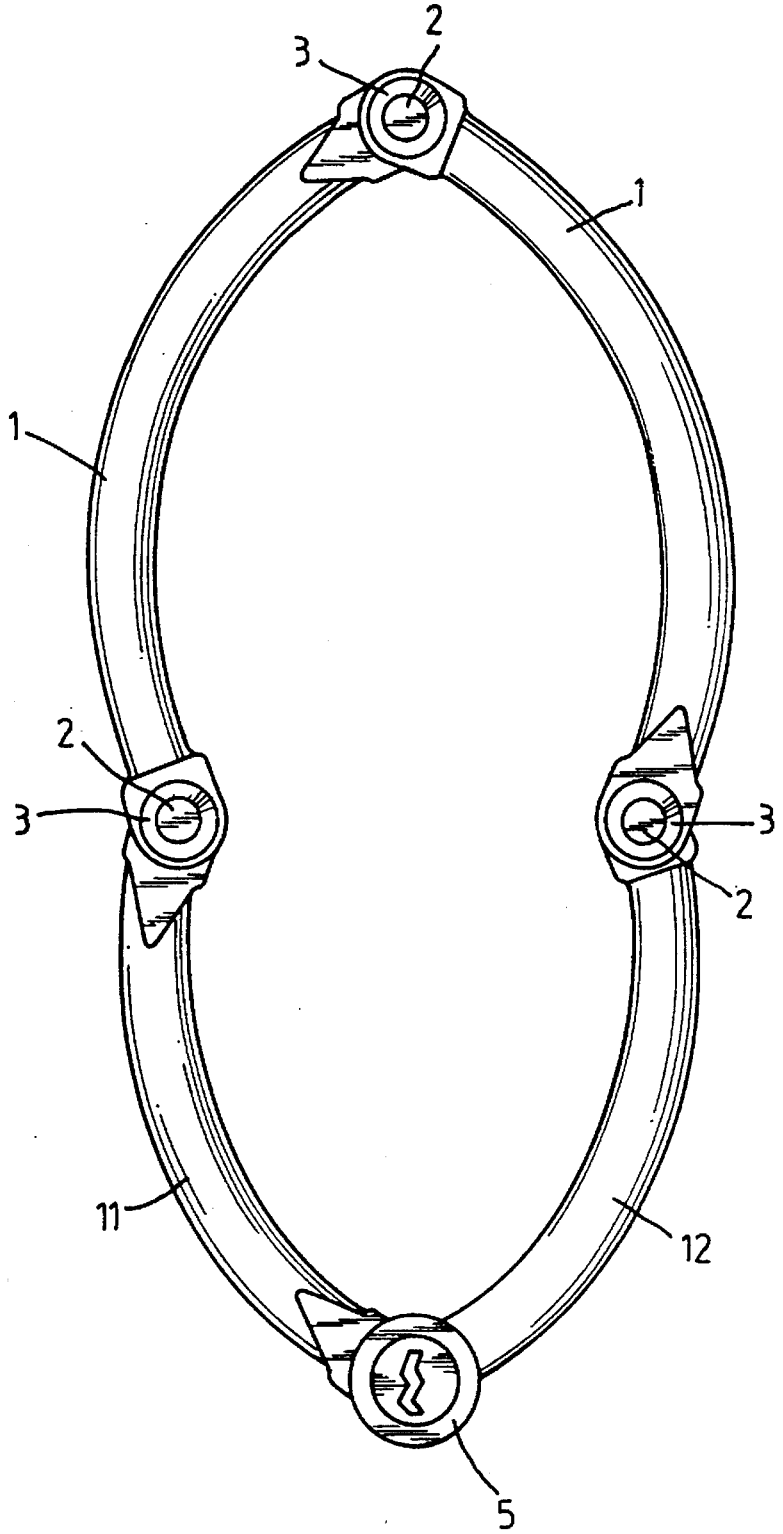
FIG. 6 is a plan view showing the present invention showing the articulated areas as being pivotable.
Figure 7:
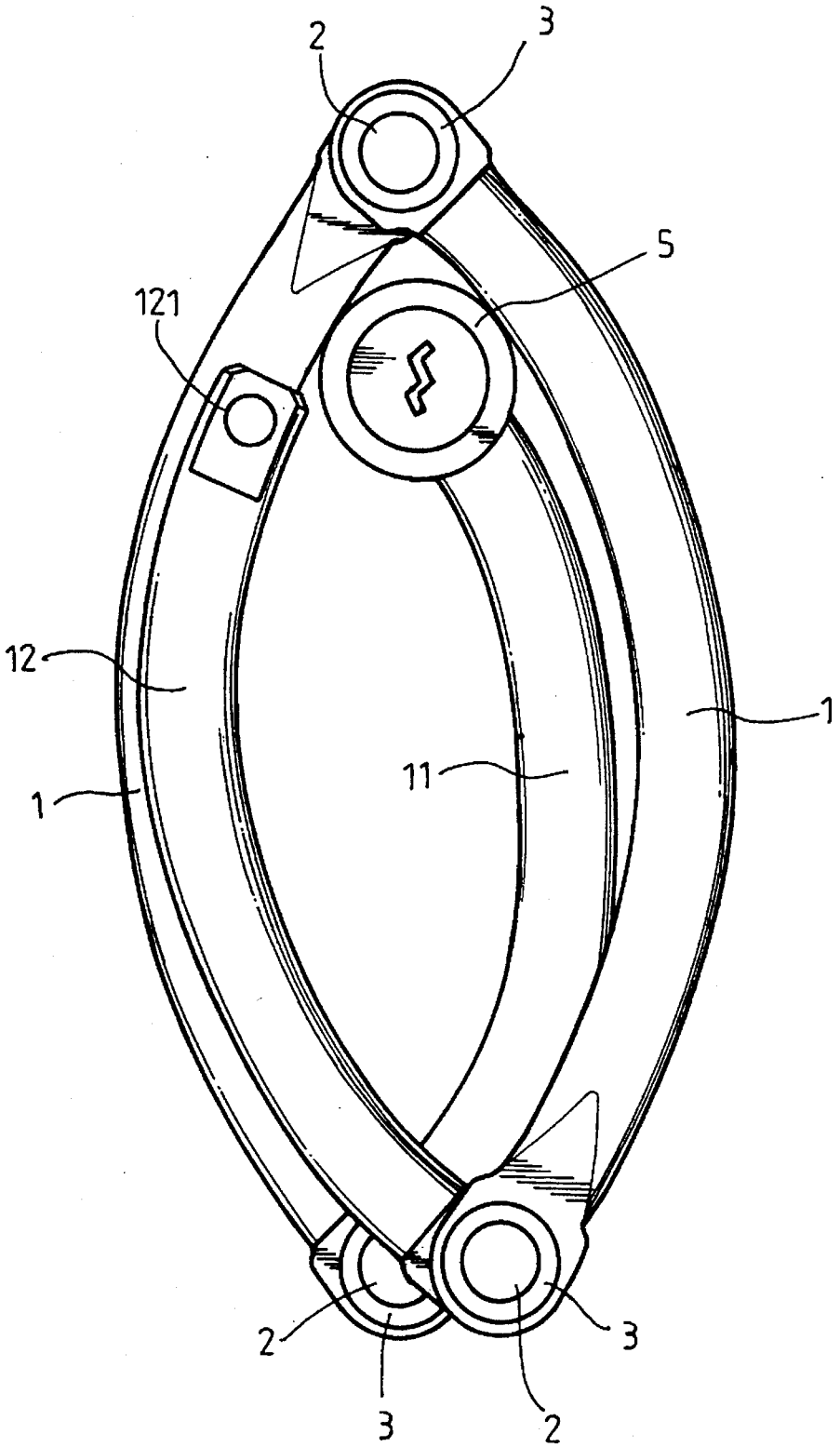
FIG. 7 is a plan view showing the present invention in a folded condition.
Figure 8:
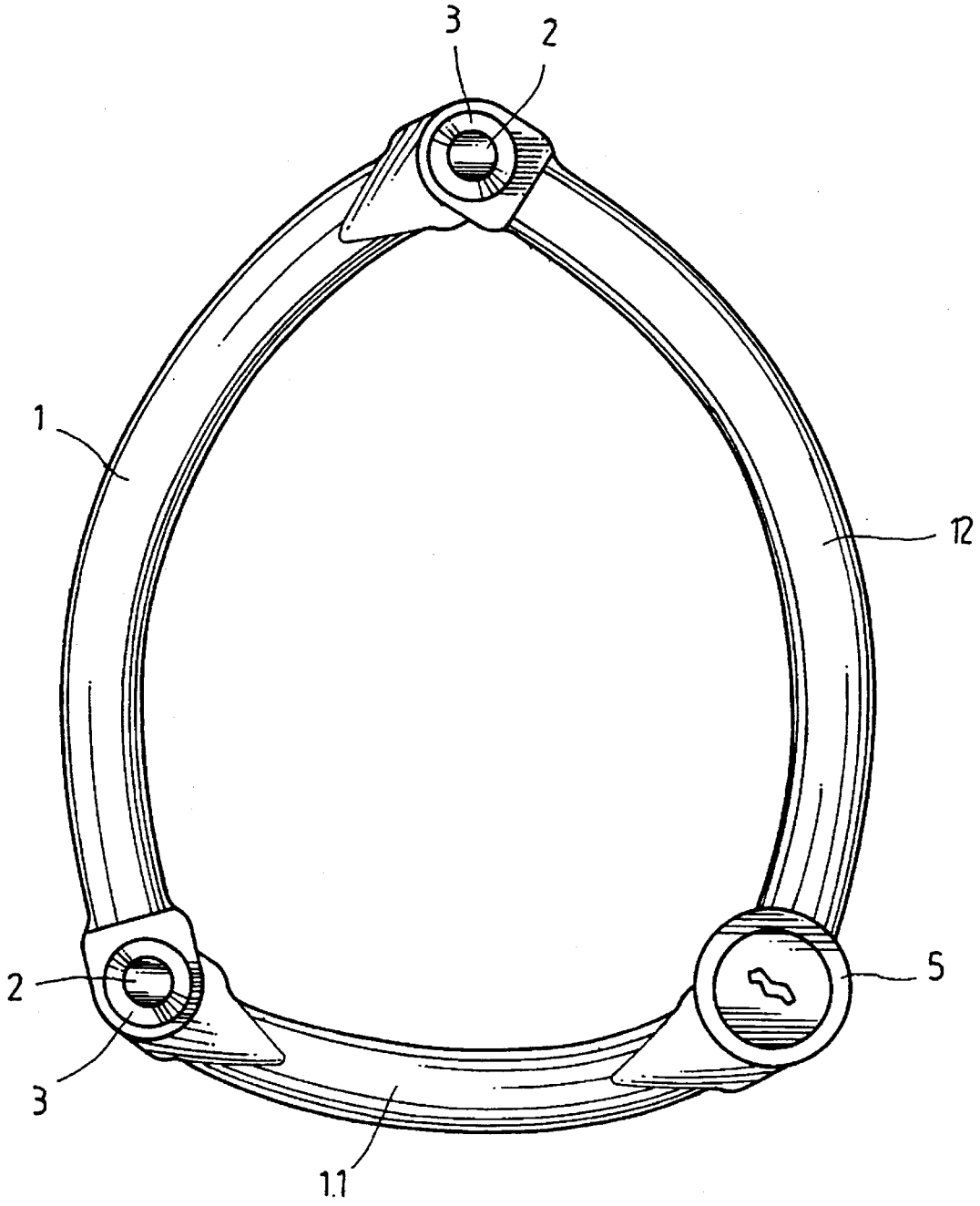
FIG. 8 is a plan view showing an alternate embodiment of the present invention in a different articulated relationship.

In order to secure an object in a limited space, the linkage is flexible by pushing the articulated areas, as shown in FIG. 6. The linkage may even be folded completely, as shown in FIG. 7. The present invention may be varied in size by adding or deducting the linkage bars 1. For instance, if the object to be secured has a larger size, more bars 1 may be employed. On the other hand, if the object to be secured is of a smaller size, less bars 1 may be employed, as shown in FIG. 8.

Figure 9:
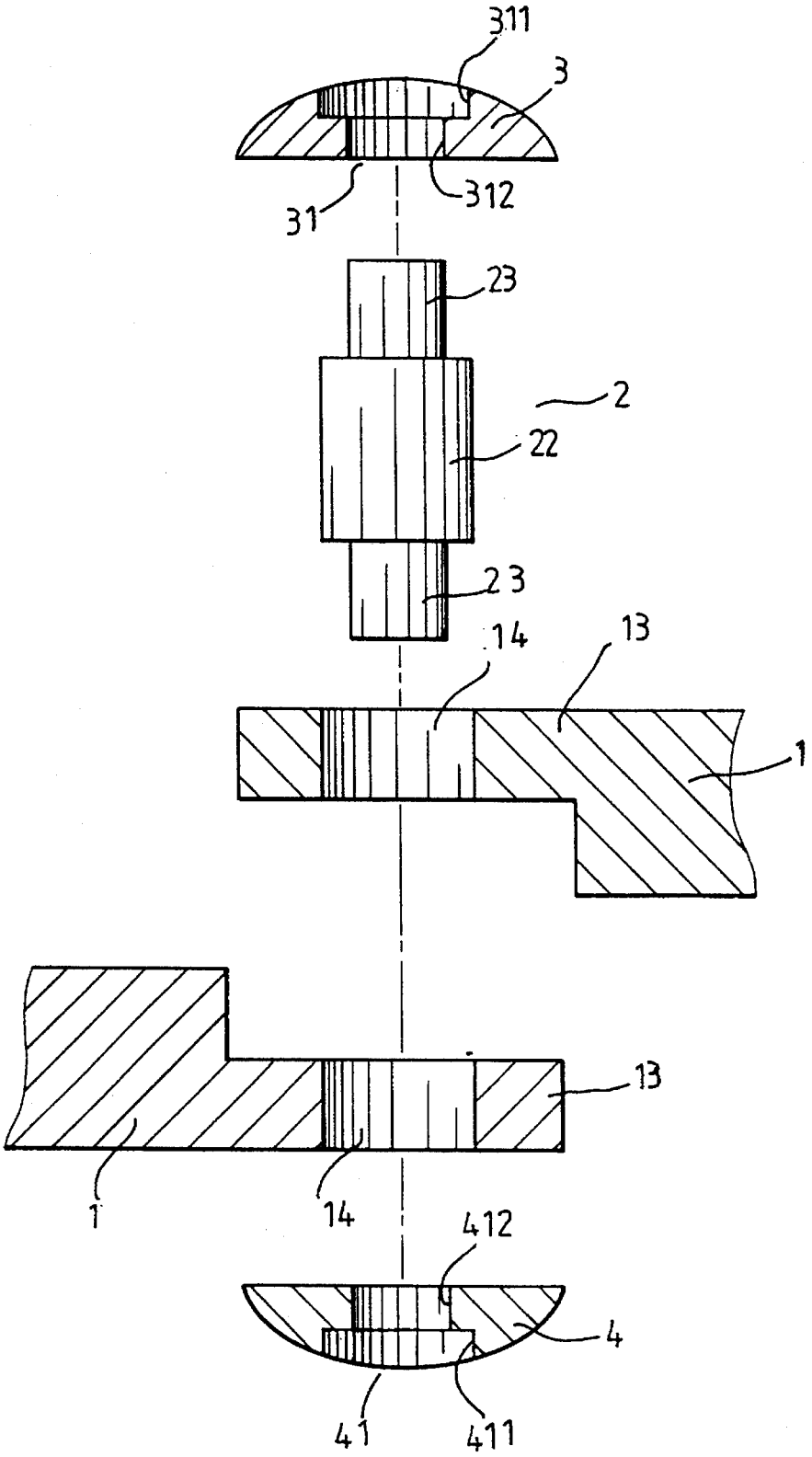
FIG. 9 is an enlarged exploded sectional view of an alternate embodiment of a linkage of the present invention.

Another embodiment of the pin 2 may be employed, as shown in FIG. 9. The pin may have an enlarged section 22 at a middle section of the pin 2, and a pair of sections 23 of reduced diameter at respective opposing ends thereof. The reduced sections 23 will be exposed outwardly from the first sections 311 and 411 of the washers and will be flattened and remain within the sections 311 and 411.

Figure 10:
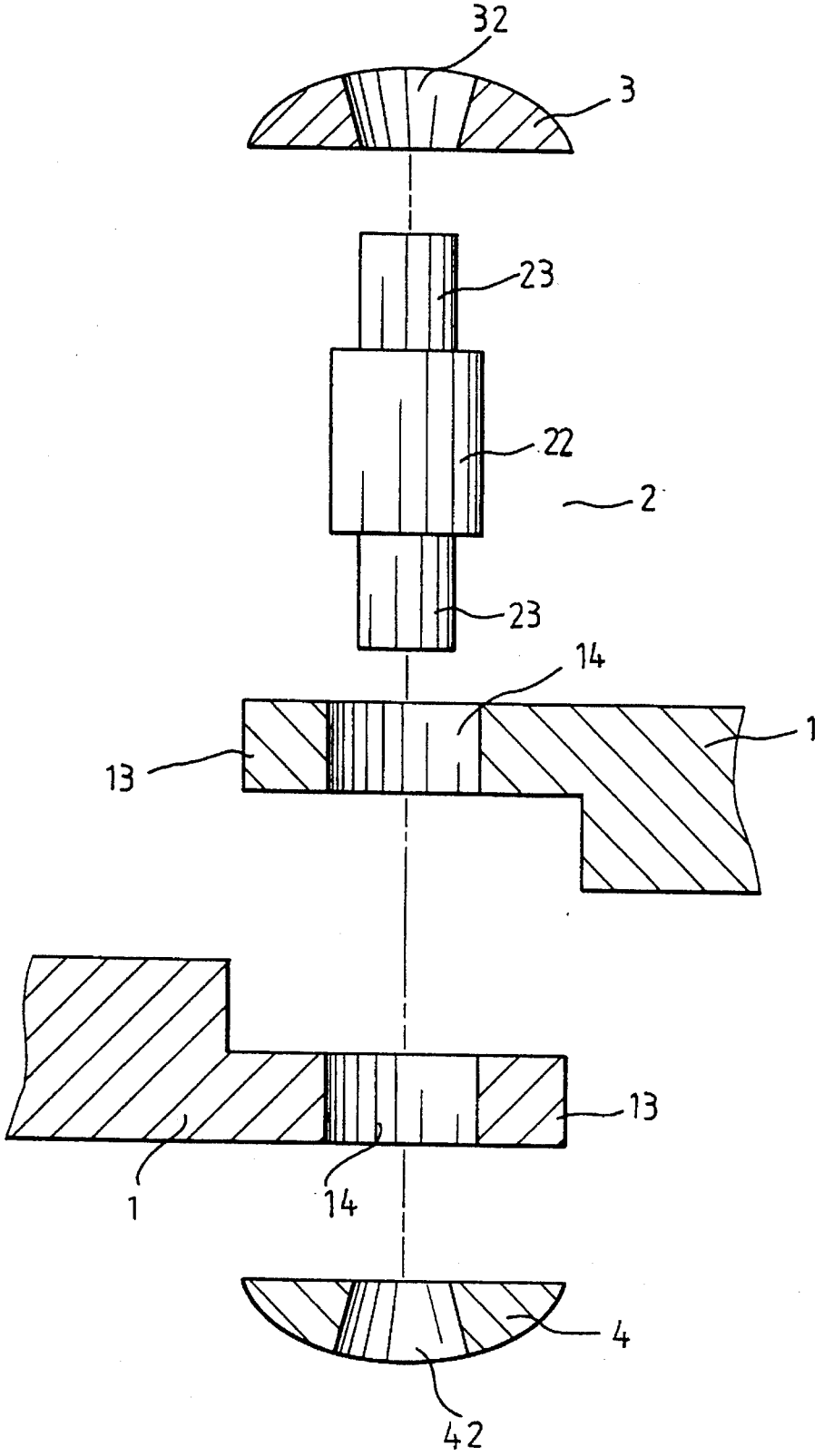
FIG. 10 is an enlarged exploded sectional view of an alternate embodiment of a linkage of the present invention.

An alternate embodiment of the washers 3 and 4 may be employed, as shown in FIG. 10. The washers 3 and 4 have through aperture 32, 42 respectively.

Figure 11:
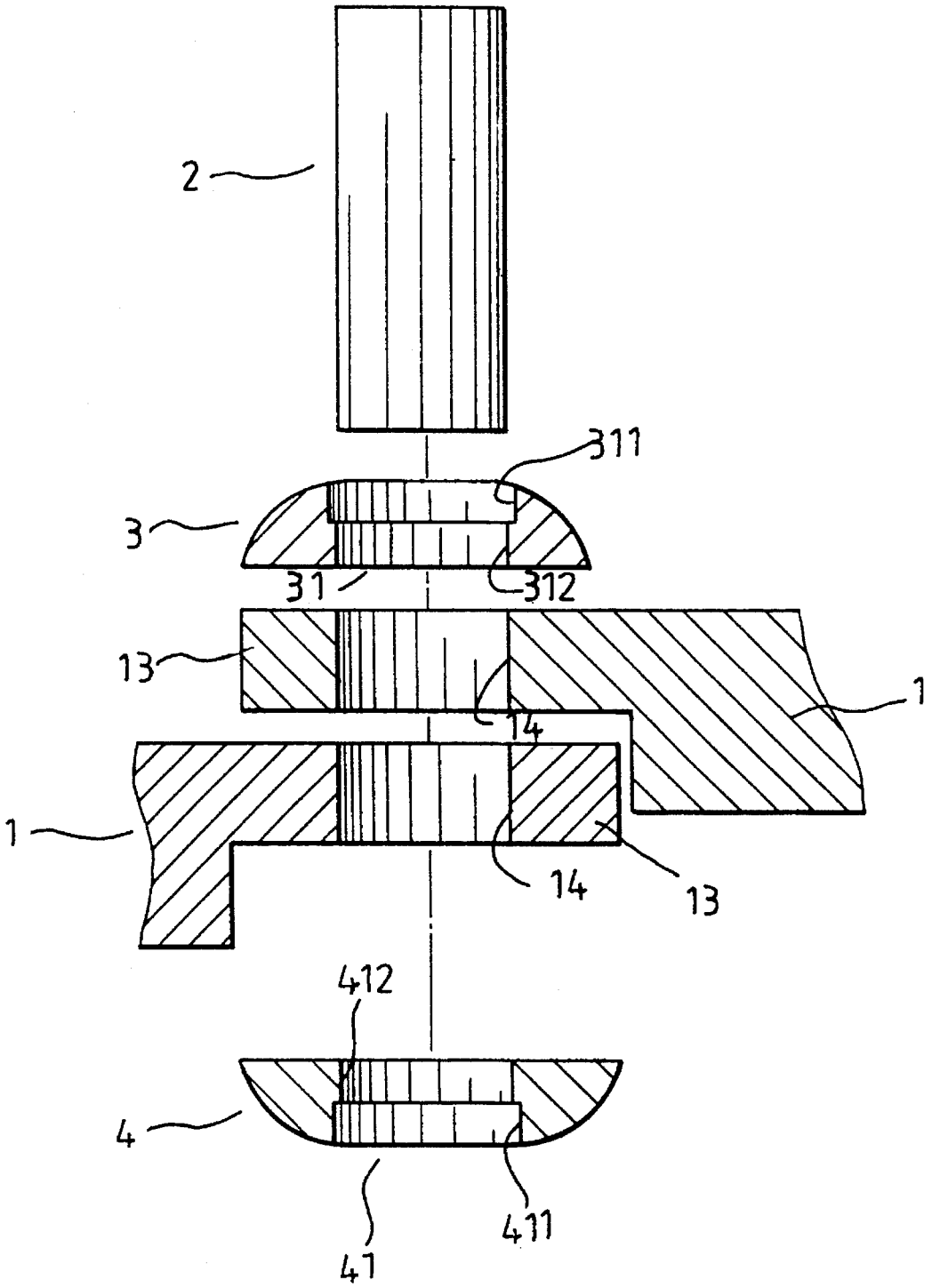
FIG. 11 is an enlarged exploded sectional view of an alternate embodiment of a linkage of the present invention.
Figure 12:
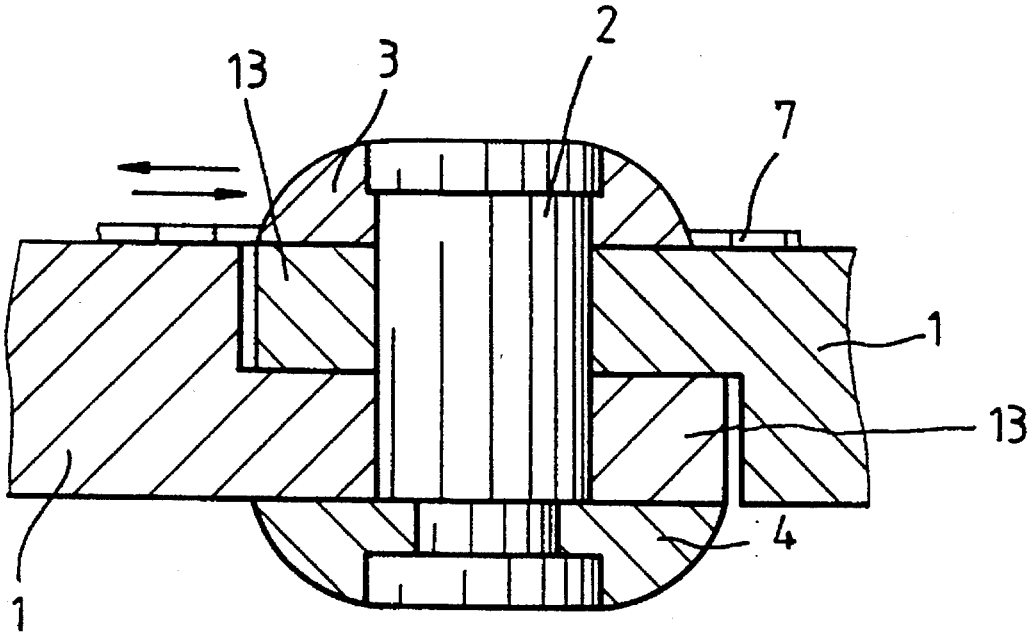
FIG. 12 is an enlarged sectional view of the linkage shown in FIGS. 9, 10 and 11 of the present invention in an engaged relationship.

Another embodiment of the pin 2 is shown in FIG. 11, the pin having a cylindrical body of constant diameter with the respective ends extending outwardly from the washer apertures 31 and 41. The exposed portions of the pin 2 are to be flattened and remain within the first sections 311 and 411 of the washers 3 and 4, as shown in FIG. 12.

Figure 13:
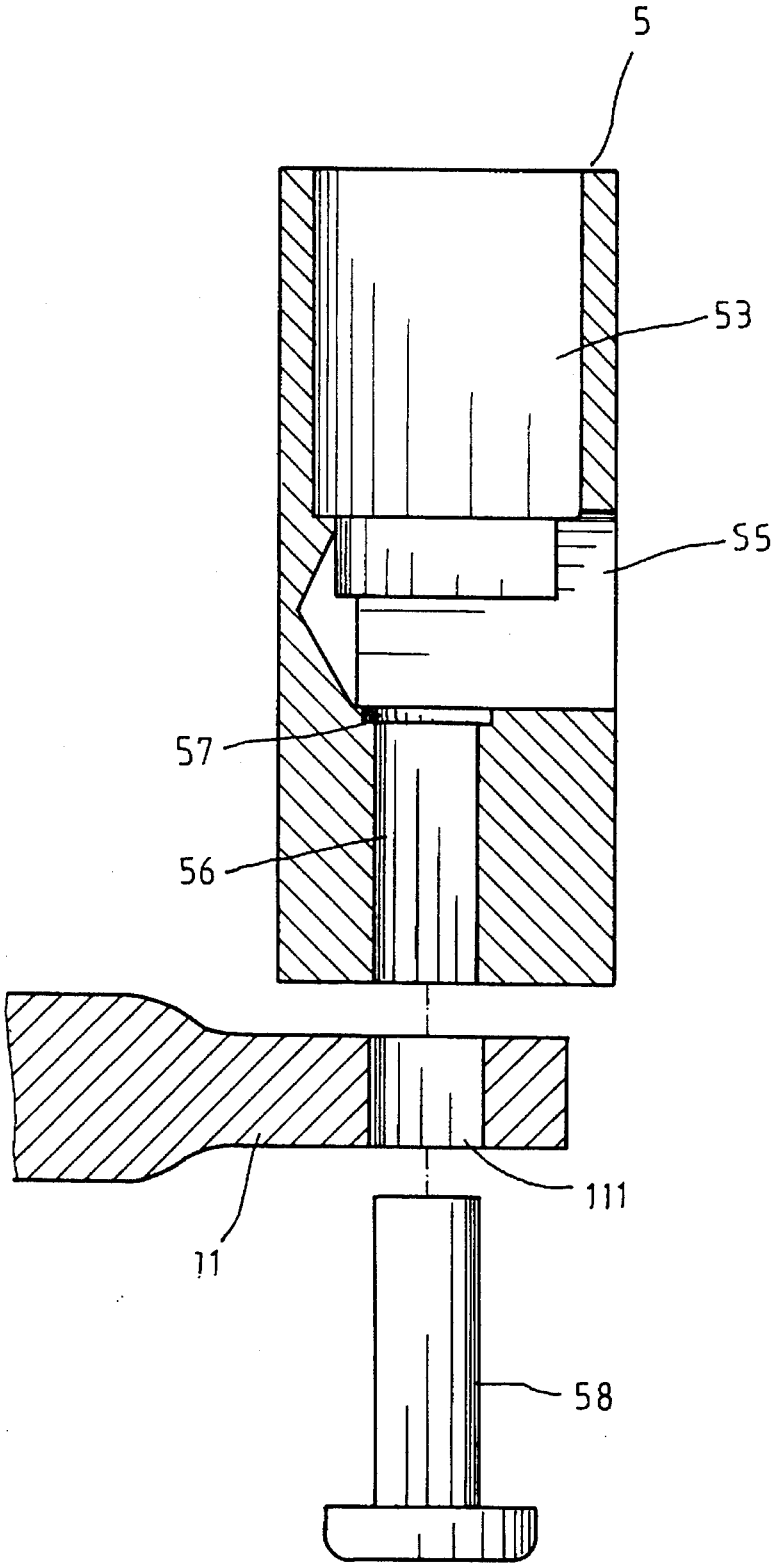
FIG. 13 is an enlarged exploded sectional view of the lock mechanism of the present invention in a disengaged relationship.

A second embodiment of the lock mechanism 5 is employed, as shown in FIG. 13, which utilizes a rivet 58 to replace the bolt 6. The rivet 58 is inserted into the lock body from the aperture 56 located at the bottom and extends outwardly from the top portion of the aperture 56. The aperture 56 comprises a larger inner diameter 57 at the top portion thereof, which is adapted to receive a flattened portion of the rivet 58 therein.

Figure 14:
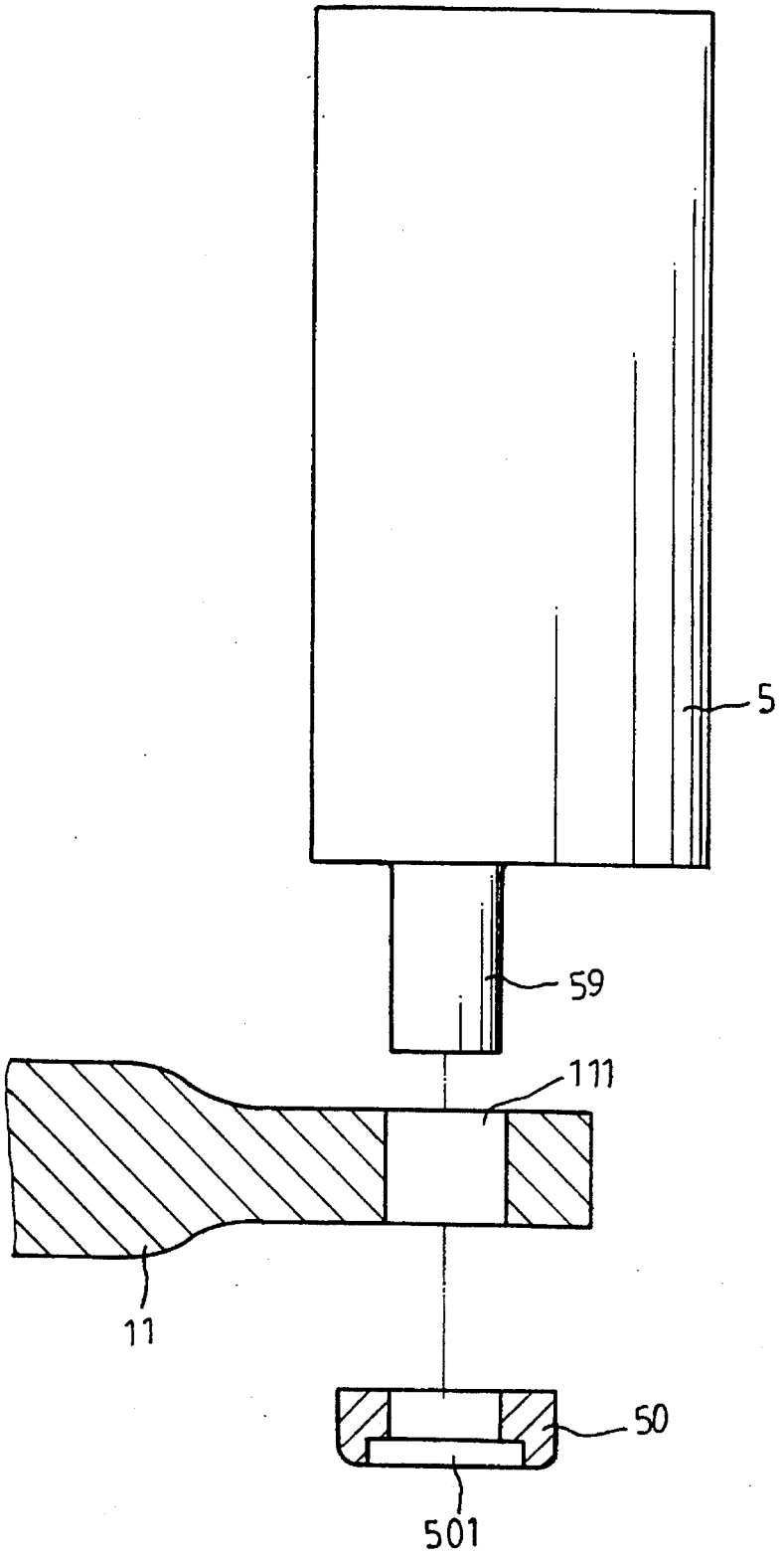
FIG. 14 is an enlarged exploded sectional view of an alternate embodiment of a lock mechanism.
Figure 15:
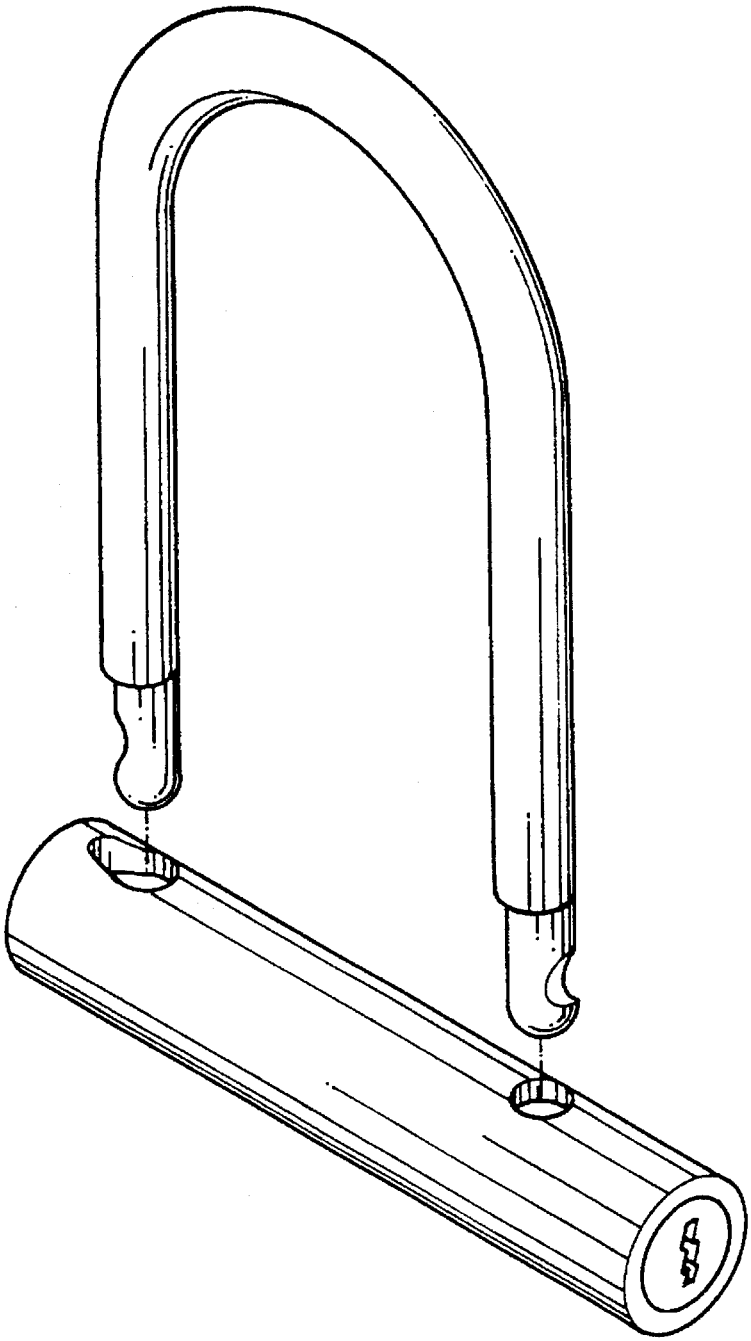
FIG. 15 (PRIOR ART)
FIGS. 15 through 19 are prior art locks.
Figure 16:
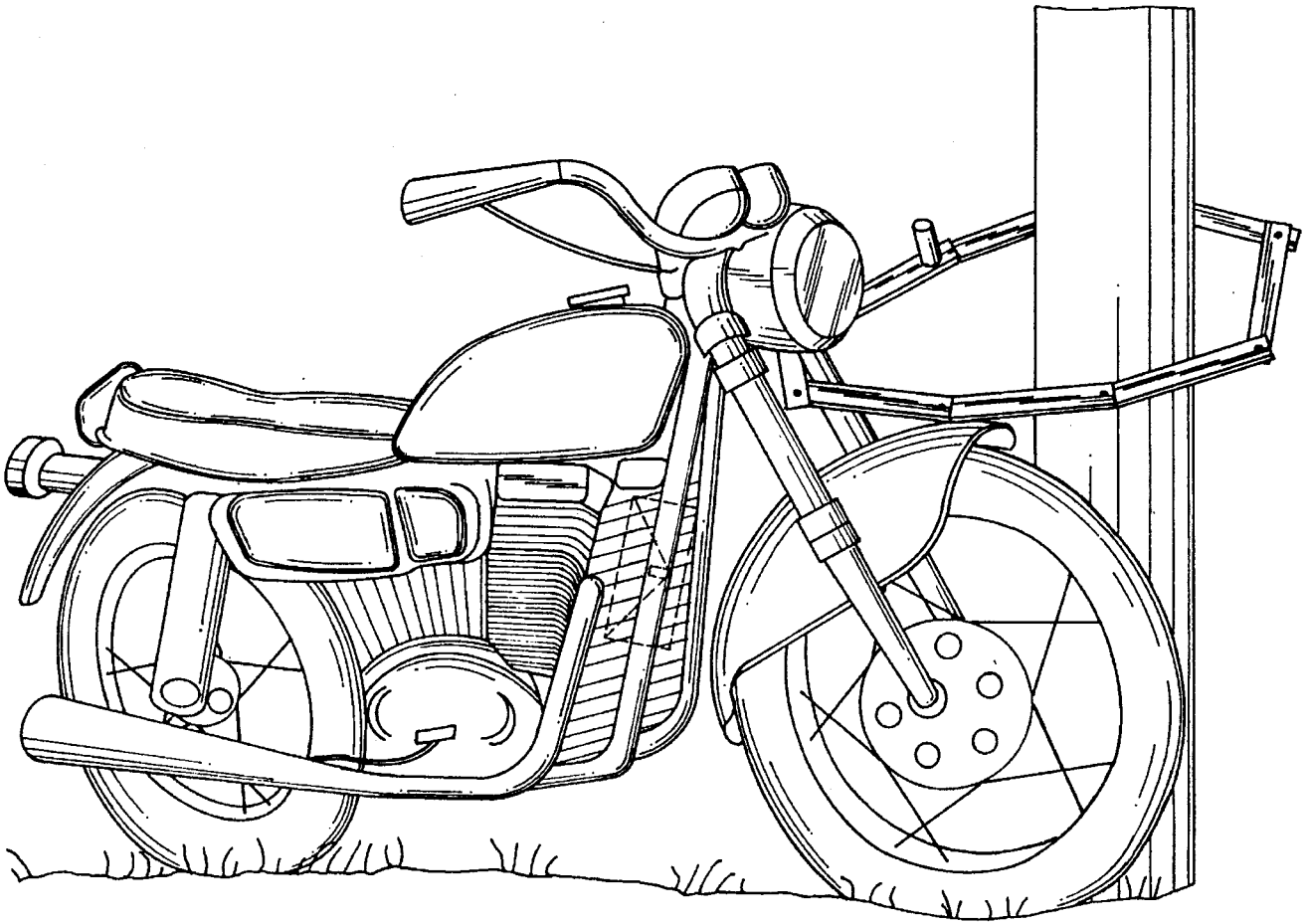
FIG. 16 (PRIOR ART)
Figure 17:
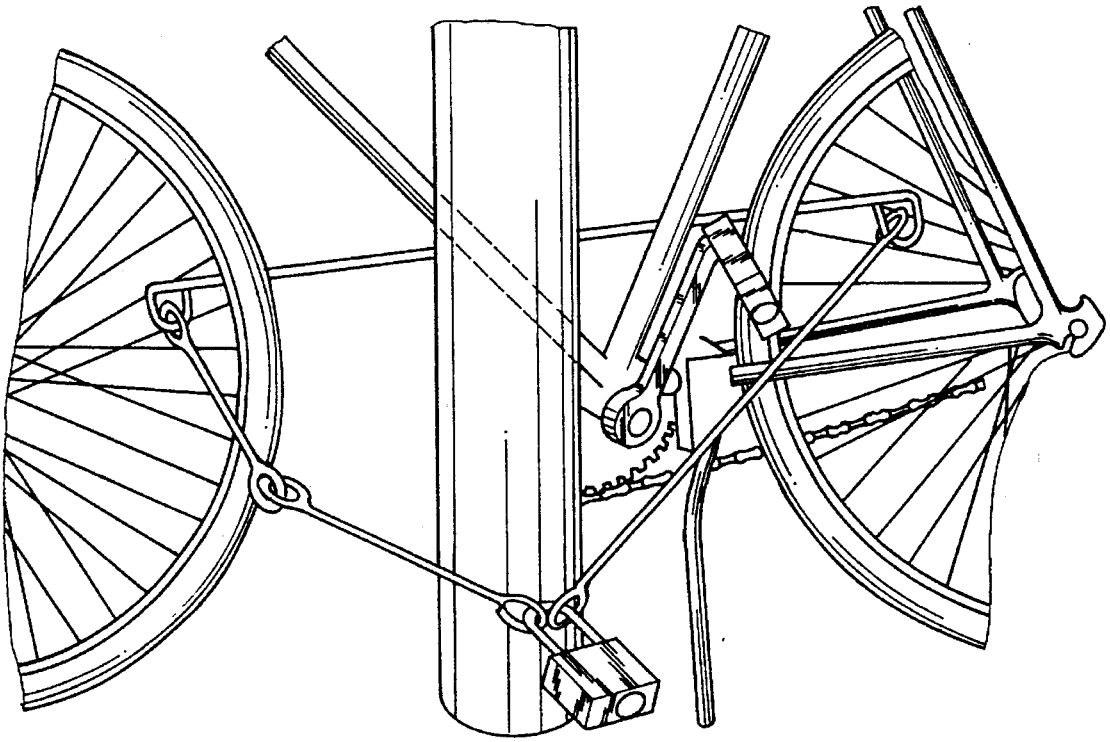
FIG. 17 (PRIOR ART)
Figure 18:
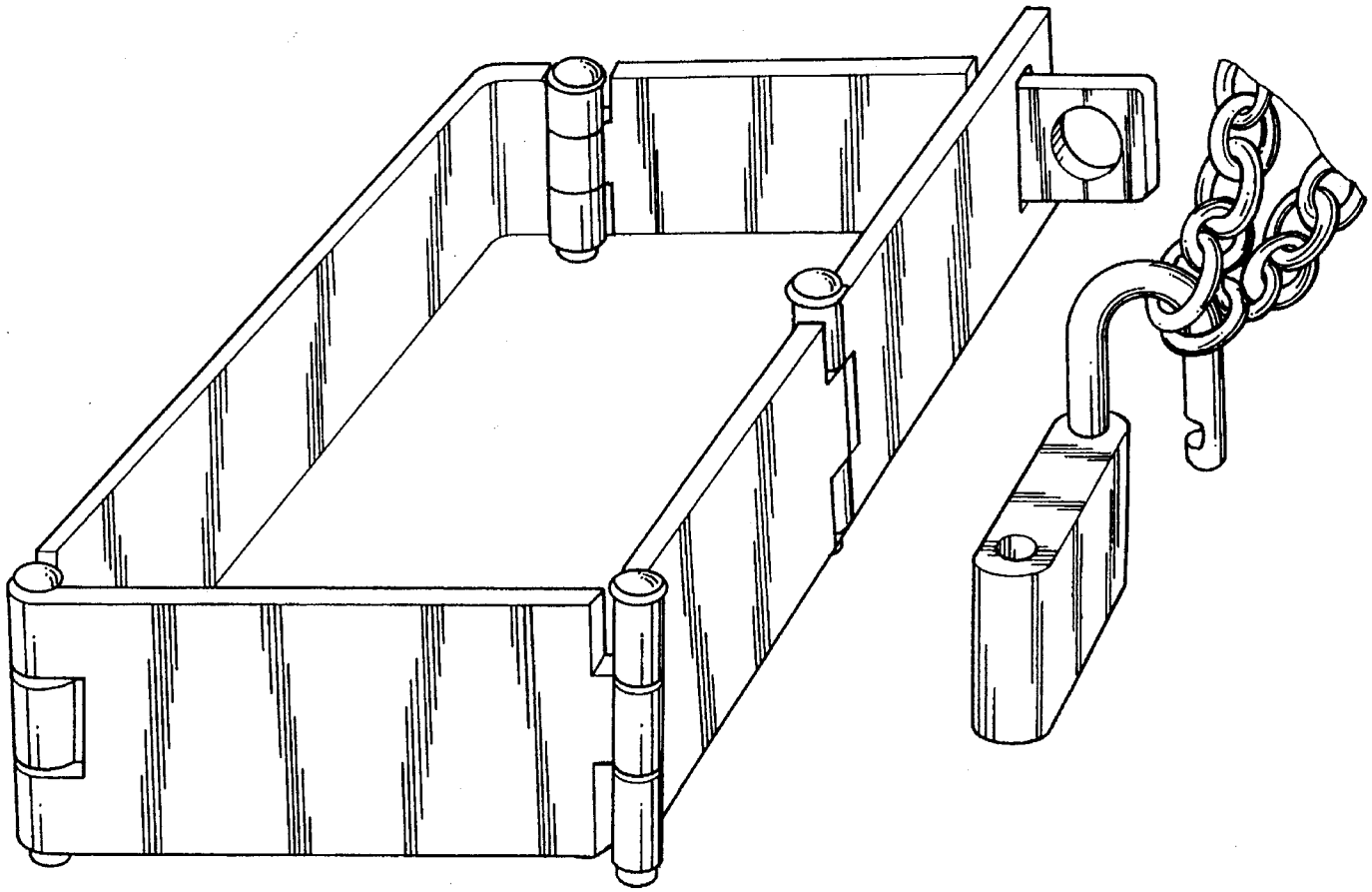
FIG. 18 (PRIOR ART)
Figure 19:
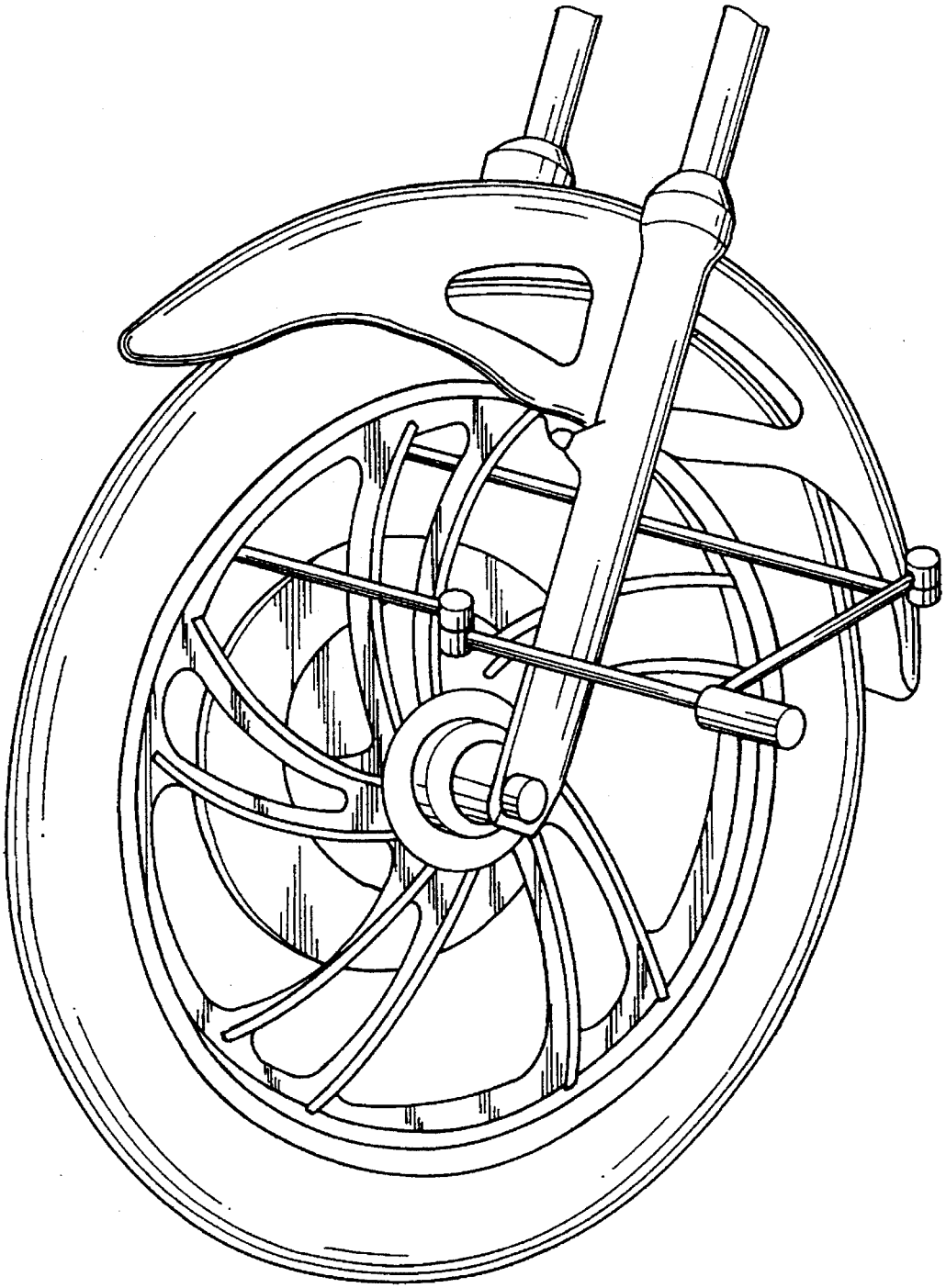
FIG. 19 (PRIOR ART)
Figure 20:
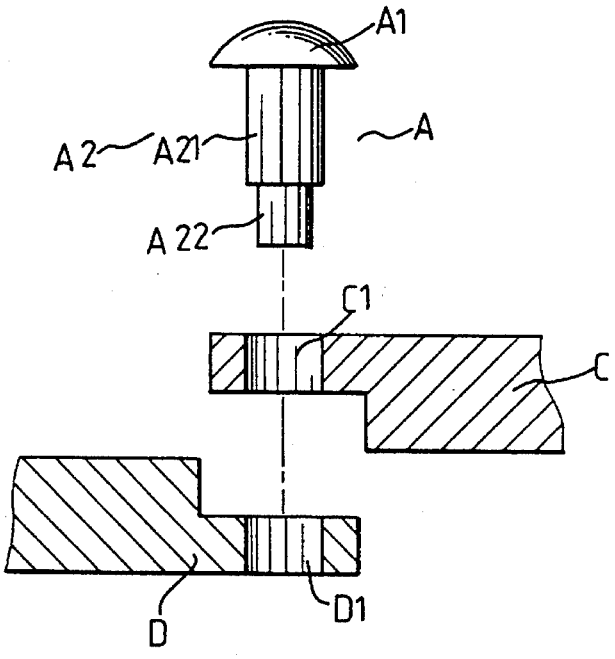
FIG. 20 (PRIOR ART)
FIGS. 20 through 22 are sectional views of a linkage of a prior art lock.
Figure 21:
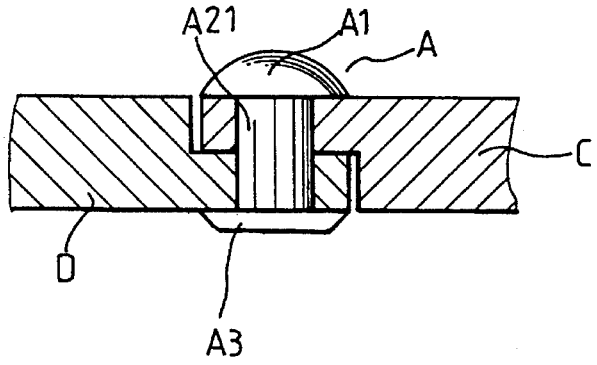
FIG. 21 (PRIOR ART)
Figure 22:
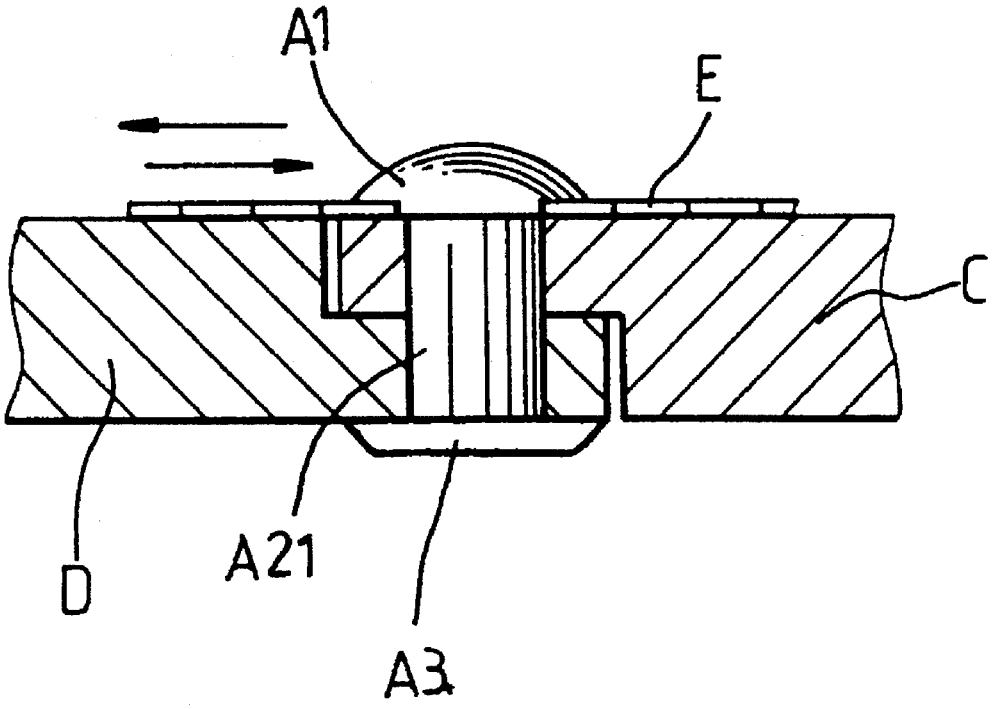
FIG. 22 (PRIOR ART)

A third embodiment of the lock mechanism 5 is shown in FIG. 14 which includes a post 59 integrally formed at the bottom portion of the lock body and extending downwardly therefrom for insertion through the aperture 111 of the bar 11 and the aperture 501 of a head 50. The exposed portion of the post 59 will be flattened and embedded within the aperture 501.

While there has been described and illustrated several embodiments of the present invention, it will be clear that variations in the details of the embodiments specifically illustrated and described may be made without departing from the true spirit and scope of the invention.

I claim:

1. A linkage locking device, comprising:

a lock mechanism, said lock mechanism including a lock housing having a cylindrical wall defining a longitudinally directed bore extending from an open first end of said housing to a bottom wall disposed on a second end thereof, said cylindrical wall having an opening formed therethrough in a direction transverse said longitudinal direction and in open communication with said bore, said lock mechanism further including a lock core secured within said bore adjacent said first end of said housing;

a first arcuate link member having a first end pivotally coupled to said lock housing adjacent said second end thereof, said first arcuate link member first end being pivotable in said transverse direction through an opening formed through said first arcuate link member first end, said first arcuate link member having a flattened second end with a through opening formed therein;

at least one second arcuate link member having a first flattened end pivotally coupled to said second flattened end of said first arcuate link member defining one of a plurality of joints, said second arcuate link member having an opposing second flattened end, each of said first and second flattened ends having a respective through opening formed therein;

a third arcuate link member having a flattened first end pivotally coupled to said second flattened end of said second arcuate link member defining another of said plurality of joints, said first end of said third arcuate link member having a through opening formed therein, said third arcuate link member having an opposing second end formed with a recessed portion from which extends an integrally formed protuberance, said second end of said third arcuate link member being insertable into said opening formed in said housing cylindrical wall for selective engagement of said protuberance by said lock core; and, means for pivotally coupling said first, second and third arcuate link members to form said plurality of joints, said pivotal coupling means including a plurality of pivot pins and a plurality of washers, each of said washers having a centrally disposed aperture formed therethrough and a circular recess formed on one side thereof concentric with said aperture, each of said pivot pins having a cylindrically shaped body portion extending longitudinally between opposing first and second ends thereof, said body portion of each pivot pin extending through one of said plurality of washers, through respective link member through openings and another of said plurality of washers said first end of each pivot pin having a head formed thereon dimensioned to be received within said circular recess of a respective one of said plurality of washers, said second end of each pivot pin being subsequently flattened, said flattened second end of said pivot pin being received within said circular recess of a respective washer, said plurality of washers being hardened by heat treatment to protect said plurality of pins from damage by externally applied shear forces.

2. The linkage locking device as recited in claim 1 further comprising a plurality of second arcuate link members pivotally coupled one to another to form a chain.

3. The linkage locking device as recited in claim 1 where said lock housing cylindrical wall has a slotted opening formed therein extending transversely into said bottom wall, said lock housing having a threaded opening formed longitudinally in said bottom wall in open communication with both said slotted opening and said bore, said lock mechanism including a fastener having a head formed on a first end thereof and a longitudinally extended body having threads formed adjacent a second end thereof, said fastener being threadedly engaged within said threaded opening to engage said first arcuate link member through said opening in said first end thereof, said second end of said threaded fastener having a slot formed therein for receiving a tool inserted into said slot of said fastener second end through said lock housing bore to facilitate said threaded engagement.

4. The linkage locking device as recited in claim 1 where said lock housing includes an integrally formed post extending longitudinally from an external surface of said bottom wall for coupling with said first arcuate link member through said opening formed in said first end thereof, said lock mechanism further including a head member having a centrally disposed aperture formed therethrough and a circular recess formed on one side thereof concentric with said aperture, said first end of said first arcuate link member being retained on said post by passage of said post through said head member aperture and receipt of a subsequently flattened distal end of said post within said head member circular recess.

* * * * *